US006318319B1

(12) United States Patent
Miyasaka et al.

(10) Patent No.: US 6,318,319 B1
(45) Date of Patent: Nov. 20, 2001

(54) VALVE TIMING CONTROL DEVICE FOR AN INTERNAL COMBUSTION ENGINE

(75) Inventors: Hideyuki Miyasaka; Yoshinori Ichinosawa; Naotaka Nakura, all of Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/661,797

(22) Filed: Sep. 14, 2000

(30) Foreign Application Priority Data

Sep. 17, 1999 (JP) ..... 11-263970

(51) Int. Cl.[7] ..... F01L 1/34
(52) U.S. Cl. ..... 123/90.17; 74/568 R; 464/2
(58) Field of Search ..... 123/90.15, 90.17, 123/90.18, 90.31; 74/568 R; 464/1, 2, 160

(56) References Cited

U.S. PATENT DOCUMENTS 5,205,249 * 4/1993 Markley et al. ..... 123/90.17
5,450,825 * 9/1995 Geyer et al. ..... 123/90.17
5,666,914 9/1997 Ushida et al. ..... 123/90.17
5,988,126 * 11/1999 Strauss et al. ..... 123/90.17

FOREIGN PATENT DOCUMENTS 08-121123 5/1996 (JP) .

* cited by examiner

*Primary Examiner*—Weilun Lo
(74) *Attorney, Agent, or Firm*—Foley & Lardner

(57) ABSTRACT

A valve timing control device disposed between a rotary element synchronously rotating with an engine and a camshaft actuating the engine valve, comprising a housing adapted to rotate with one of the rotary element and the camshaft and a vane rotor within the housing. The vane rotor has an axial bore having an open end and pressure chamber-side fluid passages open to the axial bore and is adapted to rotate with the other of the rotary element and the camshaft. Vanes radially extending from the vane rotor define within the housing fluid pressure chambers communicating with the pressure chamber-side fluid passages, respectively. A fluid control mechanism controls supply and discharge of a hydraulic fluid relative to the fluid pressure chambers. A shaft is received in the axial bore and formed with pressure source-side fluid passages connecting the pressure chamber-side fluid passages with the fluid control mechanism.

35 Claims, 5 Drawing Sheets

VALVE TIMING CONTROL DEVICE FOR AN INTERNAL COMBUSTION ENGINE

BACKGROUND OF THE INVENTION

FIELD OF THE INVENTION

The present invention relates to a valve timing control device for controlling timings of opening and closing an engine valve during the engine operation.

There is known a valve timing control device of the type, which is disposed between a rotary element rotatively driven by a crank shaft of an internal combustion engine and a cam shaft for actuating an engine valve, i.e., intake or exhaust valve. The valve timing control device is adapted to vary timings of opening and closing the engine valve by rotating the cam shaft relative to the rotary element.

Japanese Patent Application First Publication No. 8-121123 discloses a valve timing control device including a housing rotating with a rotary element driven by a crank shaft of an internal combustion engine, a rotor rotating with a cam shaft and vanes extending from the rotor. The vanes define a plurality of hydraulic fluid chambers within the housing. The device also includes a mechanism for supplying a hydraulic fluid to the chambers and discharging the hydraulic fluid therefrom. The housing and the rotor are relatively rotated by a difference of the fluid pressure within the chambers. Fluid communication between the mechanism and the chambers is established via fluid passages formed in the rotor and fluid passages formed in the cam shaft or a rotating support fixed to the cam shaft and the rotor. The rotor has an axial end face mating with an axial end face of the cam shaft or an axial end face of the rotating support. The fluid passages of the rotor and the fluid passages of the cam shaft or the rotating support are open to the corresponding axial end faces, respectively, and in axial alignment. Fluid communication between fluid paths of the mechanism and the fluid passages of the cam shaft or rotating support is established between an outer circumferential surface of the cam shaft or rotating support and an inner circumferential surface of a journal supporting the cam shaft or the rotating support.

SUMMARY OF THE INVENTION

In the conventionally proposed technique described above, it is required to increase an axial dimension of the cam shaft to assure the fluid communication between the outer circumferential surface of the cam shaft and the inner circumferential surface of the journal. This will cause an increase in dimension of the internal combustion engine as a whole, resulting in a great modification of design of the existing internal combustion engine to which the conventionally proposed valve timing control device is applied. On the other hand, it is required to increase a size of the valve timing control device to assure the fluid communication between the outer circumferential surface of the rotating support and the inner circumferential surface of the journal.

It is an object of the present invention to provide a valve timing control device reduced in size and applicable to the existing internal combustion engine.

According to one aspect of the present invention, there is provided a valve timing control device for varying an opening and closing timing of an engine valve in an internal combustion engine, the device being disposed between a rotary element synchronously rotating with the engine and a camshaft actuating the engine valve, the device comprising:

a housing adapted to rotate with one of the rotary element and the camshaft;

a vane rotor disposed within said housing, said vane rotor having an axial bore having an open end and pressure chamber-side fluid passages open to said axial bore, said vane rotor being adapted to rotate with the other of the rotary element and the camshaft;

a vane radially extending from said vane rotor and defining within said housing at least a pair of fluid pressure chambers communicating with said pressure chamber-side fluid passages, respectively, said fluid pressure chambers being circumferentially disposed within said housing;

a fluid control mechanism for supplying a hydraulic fluid to said fluid pressure chambers and discharging the hydraulic fluid therefrom; and a shaft received in said axial bore of said vane rotor through said open end, said shaft being formed with pressure source-side fluid passages communicating with said pressure chamber-side fluid passages and said fluid control mechanism.

According to a further aspect of the present invention, there is provided a valve timing control device, comprising:

a housing;

a vane rotor with at least one vane and rotatable relative to said housing, said vane rotor having an axial bore and fluid passages open to the axial bore;

at least a pair of fluid pressure chambers defined by the housing and the vane rotor with the vane, said fluid passages being open to the fluid pressure chambers, respectively;

a lock mechanism for restricting relative rotation of the housing and the rotor, said lock mechanism comprising a fluid pressure chamber fluidly communicated with one of the pair of fluid pressure chambers;

a fluid control mechanism for supplying a hydraulic fluid to the fluid pressure chambers and discharging the hydraulic fluid therefrom;

a shaft received in the axial bore of the rotor;

first communication fluid path communicating with one of the pair of fluid pressure chambers and the fluid control mechanism via the corresponding fluid passage, said first communication fluid path being formed in the shaft; and second communication fluid path communicating with the other of the pair of fluid pressure chambers and the fluid control mechanism via the corresponding fluid passage, said second communication fluid path being formed in the shaft.

DESCRIPTION OF THE PREFERRED EMBODIMENT

Referring now to FIGS. 1–4, a first preferred embodiment of a valve timing control device for an internal combustion engine, according to the present invention, is explained.

Figure 1:
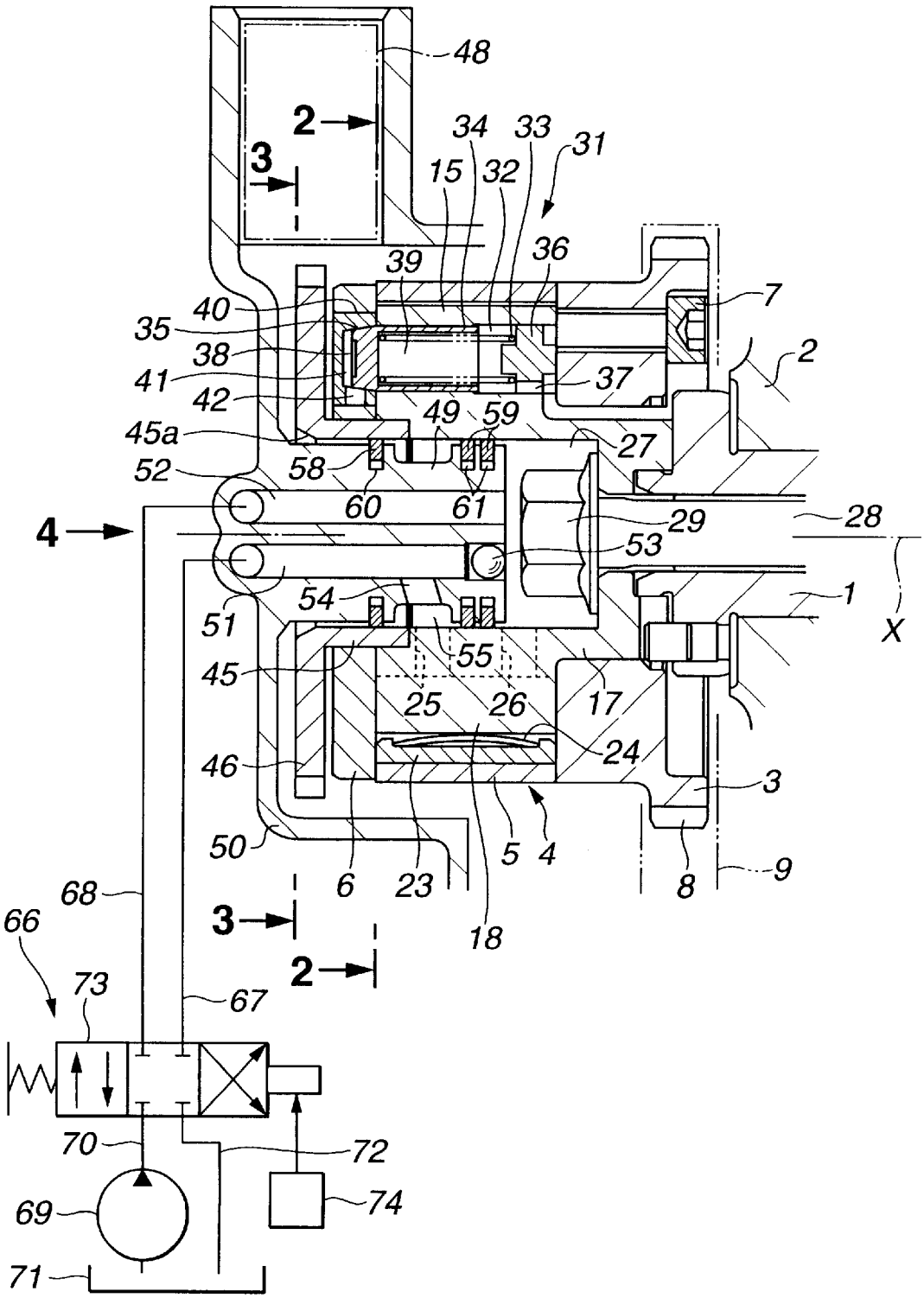
FIG. 1 shows a valve timing control device for an internal combustion engine, of a first embodiment, according to the present invention, partially in section taken along an axis X.

In FIG. 1, a reference numeral 1 denotes a cam shaft adapted to actuate an engine valve, namely, an intake or exhaust valve. In this embodiment, the cam shaft 1 is adapted for driving the intake valve. The cam shaft 1 is rotatably supported by a bearing 2 fixed to an engine cylinder head, not shown. The cam shaft 1 is formed with cams, not shown, on its base portion, not shown, located on the right side of the bearing 2 in FIG. 1. The cams actuate the intake valve to open and close. The cam shaft 1 is rotatably driven by a rotary element 3 synchronously rotated with the engine. In this embodiment, the rotary element 3 is a sprocket rotated by a crank shaft, not shown, of the engine. The rotary element 3 is rotatable relative to the cam shaft 1 by a predetermined angle. The rotary element 3 has an outer gear 8 on an outer circumference thereof, on which a timing chain 9 driven by the crank shaft is wound. The rotary element 3 is connected with a housing 4 of the valve timing control device by means of a connecting bolt 7 and thus rotatable with the housing 4.

Figure 2:
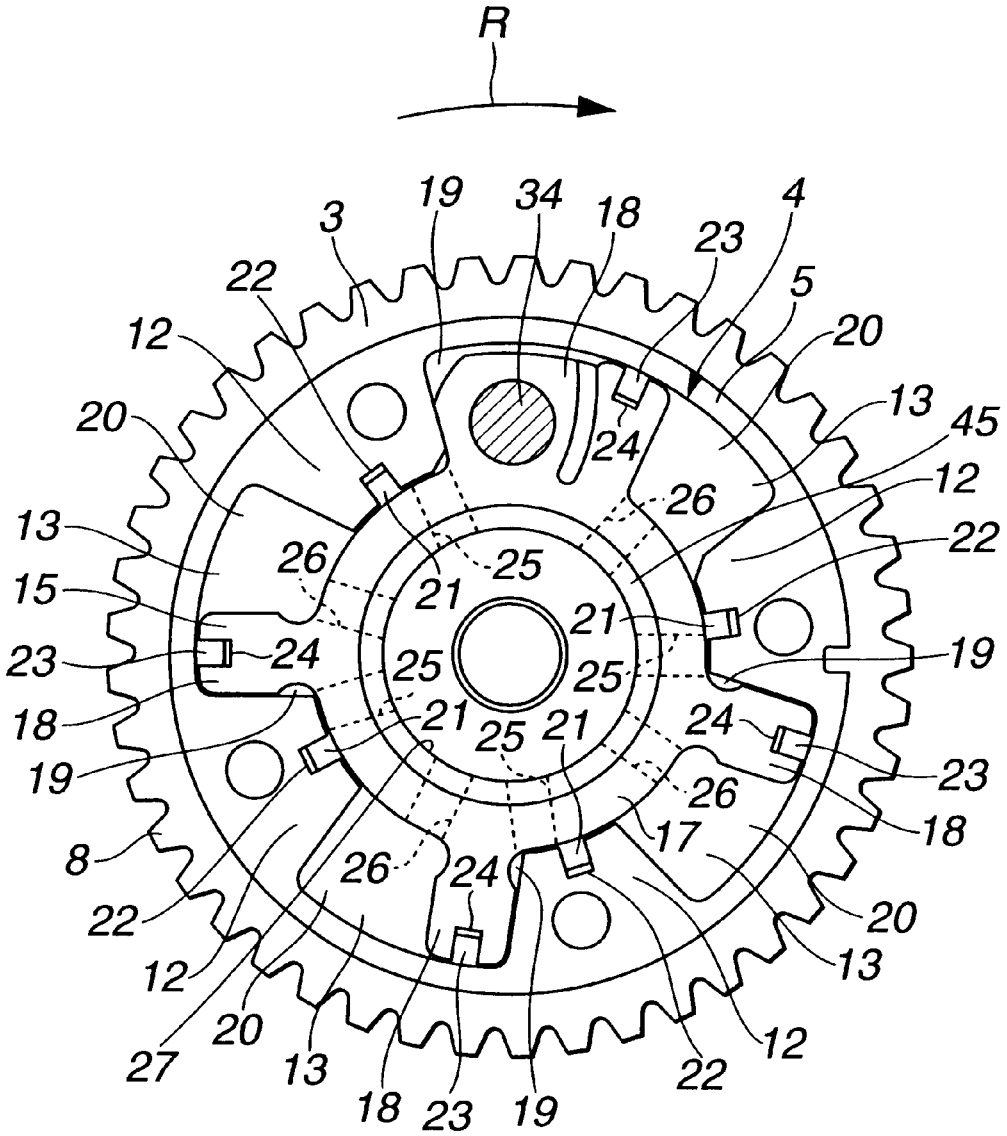
FIG. 2 is a section taken along line 2—2 of FIG. 1 with omitting a shaft and a connecting bolt.
Figure 3:
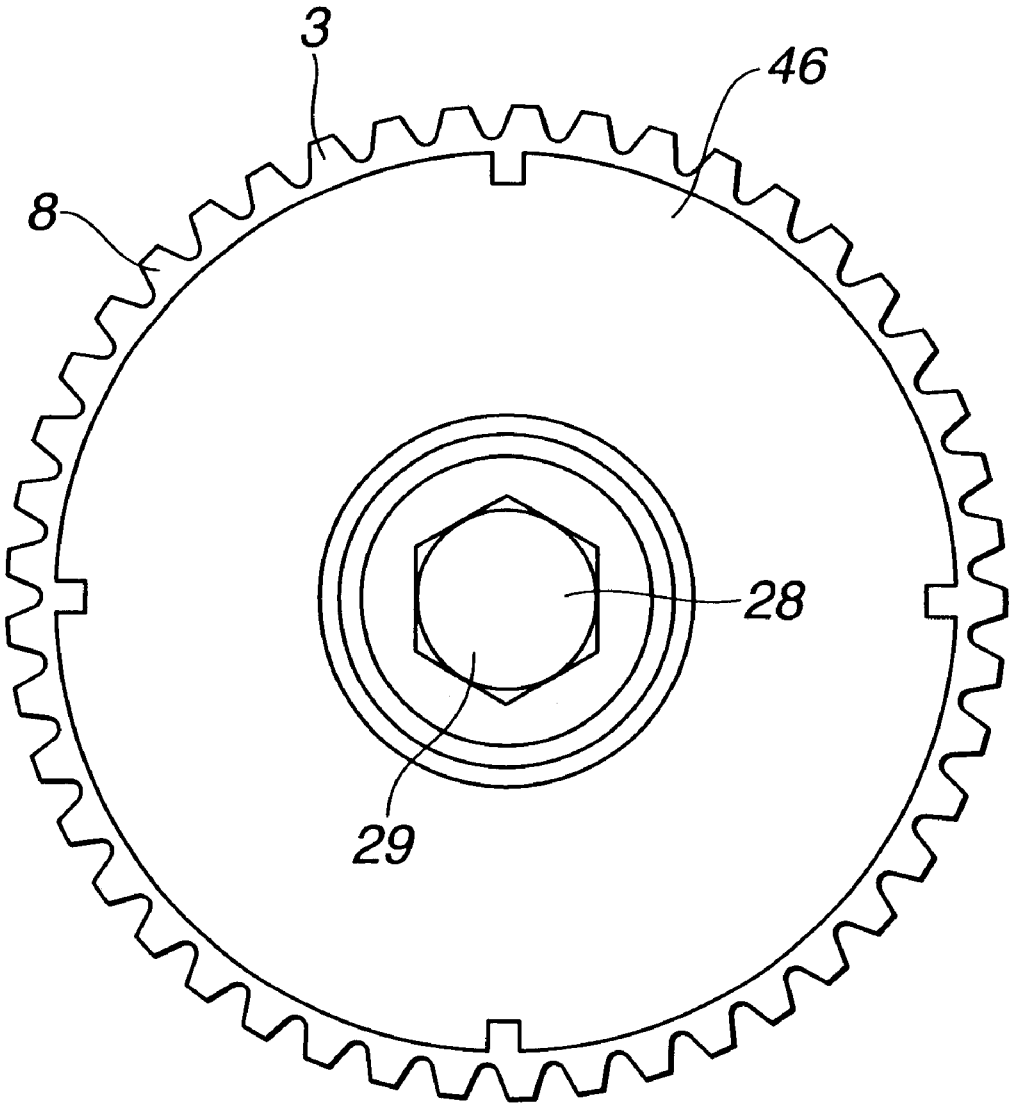
FIG. 3 is a section taken along line 3—3 of FIG. 1 with omitting the shaft.

As illustrated in FIG. 1, the housing 4 includes an annular shell 5 and an end plate 6 closing one end of the shell 5. As shown in FIG. 2, the shell 5 is formed with a plurality of radially inward extending projections 12, four projections in this embodiment, circumferentially spaced from each other. The projections 12 define four chambers 13 circumferentially arranged therebetween.

Referring back to FIG. 1, the valve timing control device includes a vane rotor 15 that is disposed within the housing 4 so as to be rotatable about a rotation axis X by a predetermined angle relative to the housing 4. The vane rotor 15 is coaxially arranged with the cam shaft 1 and connected therewith by a connecting bolt 28. The device has a cylindrical axial bore 27 extending in the rotation axis X and formed by the vane rotor 15 and a sleeve 45 connected with the vane rotor 15 in substantially coaxial alignment therewith. Specifically, the vane rotor 15 includes a hub portion 17 having an inner circumferential surface that defines the axial bore 27 in cooperation with an inner circumferential surface of the sleeve 45. The hub portion 17 has an axial end wall defining a bottom of the axial bore 27. The axial bore 27 has an open end at an axial end of the sleeve 45. The axial end wall of the hub portion 17 has an axially extending bolt hole communicated with the axial bore 27. The bolt 28 is inserted into the bolt hole via the axial bore 27 so that a head 29 of the bolt 28 is disposed on the bottom of the axial bore 27. The vane rotor 15 also includes at least one vane 18, a plurality of vanes 18 in this embodiment, radially outward extending from the hub portion 17. The hub portion 17 acts as a bearing for the rotary element 3 and the shell 5 of the housing 4.

As best shown in FIG. 2, the vanes 18, four vanes 18 in this embodiment, are circumferentially spaced from each other. Each of the vanes 18 is disposed within each chamber 13 of the housing 4 and divides the chamber 13 into a pair of fluid pressure chambers 19 and 20. Fluid communication between the chambers 19 and 20 is prevented using seals 21 and 23 and springs 22 and 24. The seal 21 is disposed at an inward end of the projection 12 of the shell 5 of the housing 4 and biased by the spring 22 against an outer circumference of the hub portion 17 of the vane rotor 15. The seal 23 is disposed at an inward end of the vane 18 and biased by the spring 24 against an inner circumference of the shell 5. The vane rotor 15 includes a pressure chamber-side fluid passage 25 radially extending and communicated with the fluid pressure chamber 19 and a pressure chamber-side fluid passage 26 radially extending and communicated with the fluid pressure chamber 20. The pressure chamber-side fluid passages 25 and 26 extend through the hub portion 17 and are open to the axial bore 27 at inner ends thereof and the fluid pressure chambers 19 and 20 at outer ends thereof, respectively. The pressure chamber-side fluid passages 25 and 26 are spaced from each other in the axial direction of the axial bore 27 as shown in FIG. 1. With the arrangement, the housing 4 and the vane rotor 15 are relatively rotatable within a predetermined range of angle by selectively supplying a hydraulic fluid to the fluid pressure chamber 19 or 20 and discharging the fluid therefrom via the pressure chamber-side fluid passage 25 or 26.

By the selective shift of the hydraulic fluid between the fluid pressure chambers 19 and 20, the housing 4 connected with the rotary element 3 can be rotated relative to the vane rotor 15 connected with the cam shaft 1 within the predetermined angle range. The housing 4 and the vane rotor 15 thus constitute a relative rotation mechanism for rotating the rotary element 3 relative to the cam shaft 1.

Disposed between the housing 4 and the vane rotor 15 is a lock mechanism 31 for restricting relative rotation of the housing 4 and the vane rotor 15. In this embodiment, the lock mechanism 31 includes a lock pin 34 moveably disposed within a cylinder bore 32 of the vane rotor 15 and a lock hole 35 engageable with the lock pin 34 within the housing 4. The cylinder bore 32 is formed in one of the vanes 18 which has an increased circumferential length as shown in FIG. 2, and extends therethrough in the axial direction of the vane rotor 15. A spring 33 biasing the lock pin 34 toward the lock hole 35 is disposed within the cylinder bore 32 and supported at one end thereof by a spring retainer 36. The spring retainer 36 is press-fitted into one end of the cylinder bore 32 which is located on a rear end of the lock pin 34. The spring retainer 36 is preferably made of a material having hardness higher than that of the vanes 18. The spring retainer 36 has a vent groove 37 in a predetermined outer circumferential portion thereof through which the cylinder bore 32 is exposed to atmospheric air. The lock pin 34 is formed of a generally cylindrical shape and has a tapered closed-end portion formed with a recess 38 and a blind hole 39 open to the rear end face. An opposite end of the spring 33 is supported at the bottom of the blind hole 39. The thus constructed lock pin 34 is reduced in weight.

The lock hole 35 is formed in a receptacle 40 embedded in the end plate 6 of the housing 4. The receptacle 40 is made of a material having hardness higher than that of the end plate 6. The receptacle 40 is in the form of one open ended cup-shape defining the generally cup-shaped lock hole 35. The receptacle 40 includes a large inner diameter portion at the open end and a small inner diameter portion at the closed end. The small inner diameter portion of the receptacle 40 cooperates with the tapered end portion of the lock pin 34 to define a fluid pressure chamber 41. The fluid pressure chamber 41 is communicated with the fluid pressure chamber 19 via a fluid hole 42 radially outward extending through the receptacle 40.

The sleeve 45 is received through an opening of the end plate 6 and connected with the hub portion 17 of the vane rotor 15. The sleeve 45 axially extends over a connection in which the shell 5 and the end plate 6 are joined together. The sleeve 45 has at its axial end a guide portion **45*a* tapered so as to gradually increase an inner diameter of the sleeve 45 for guiding or easily receiving parts such as seals 58 and 59 explained later. A target plate 46 used for detecting a cam angle is integrally formed with the guide portion 45*a* of the sleeve 45. The target plate 46 includes a portion radially extending from the guide portion 45*a*. The portion is disposed between the end plate 6 and a cover 50 enclosing the valve timing control device, in the direction of the rotation axis X. A cam angle sensor 48 is mounted to the cover 50 in an opposed relation to the target plate 46. The cam angle sensor 48 is located perpendicular to the rotation axis X. The cam angle sensor 48 senses concaved and convexed portions formed in an outer periphery of the target plate 46**, to thereby detect the cam angle.

A shaft 49 is disposed within the axial bore 27 in a coaxial relation to the vane rotor 15 and the sleeve 45. The shaft 49 may be integrally formed with the cover 50. The shaft 49 includes pressure source-side fluid passages 51 and 52 extending in the axial direction. The pressure source-side fluid passage 51 has an end closed by a plug 53 opposed to the bottom of the axial bore 27. A branch passage 54 is branched from the pressure source-side fluid passage 51 in an inclined relation thereto and connected with a circumferential groove 55 circumferentially extending in an outer circumferential surface of the shaft 49. The pressure source-side fluid passage 51 thus is communicated with the pressure chamber-side fluid passage 25 of the vane rotor 15 via an annular space defined by the shaft 49 within the axial bore 27. The pressure source-side fluid passage 52 is open to an axial end surface of the shaft 49 that is opposed to the bottom of the axial bore 27. The pressure source-side fluid passage 52 is open to a bottom portion of the axial bore 27 and thus communicated with the pressure chamber-side fluid passage 26 of the vane rotor 15 via the bottom portion of the axial bore 27.

The seals 58 and 59 are disposed within the annular space between the outer circumferential surface of the shaft 49 and the inner circumferential surfaces of the hub portion 17 and the sleeve 45. The seals 58 and 59 cooperate to prevent fluid communication between the pressure chamber-side fluid passages 25 and 26 via the annular space. The seals 58 and 59 are arranged spaced from each other in the axial direction of the shaft 49 such that the circumferential groove 55 is disposed therebetween. The seals 58 and 59 divide the axial bore 27 into portions including the bottom portion to which the fluid passage 26 is open, an open-end portion located near the guide portion 45*a* of the sleeve 45, and an intermediate portion between the bottom portion and the open-end portion, to which the circumferential groove 55 is open. The seal 58 is located within the open-end portion of the axial bore 27. The seal 58 is received in a seal groove 60 circumferentially extending on the outer circumferential surface of the shaft 49 and in contact with the inner circumferential surface of the sleeve 45. On the other hand, the seal 59 is located within the bottom portion of the axial bore 27. The seal 59 is received in a seal groove 61 circumferentially extending in the outer circumferential surface of the shaft 49 and in contact with the inner circumferential surface of the hub portion 17. In this embodiment, the seal 59 is constituted by two axially spaced seals received in two grooves as the seal groove 61 which are arranged corresponding to the seals. The sleeve 45 contacted with the seal 58 and the vane rotor 15 contacted with the seal 59 may be made of a high hardness material such as an iron-based material.

Figure 4:
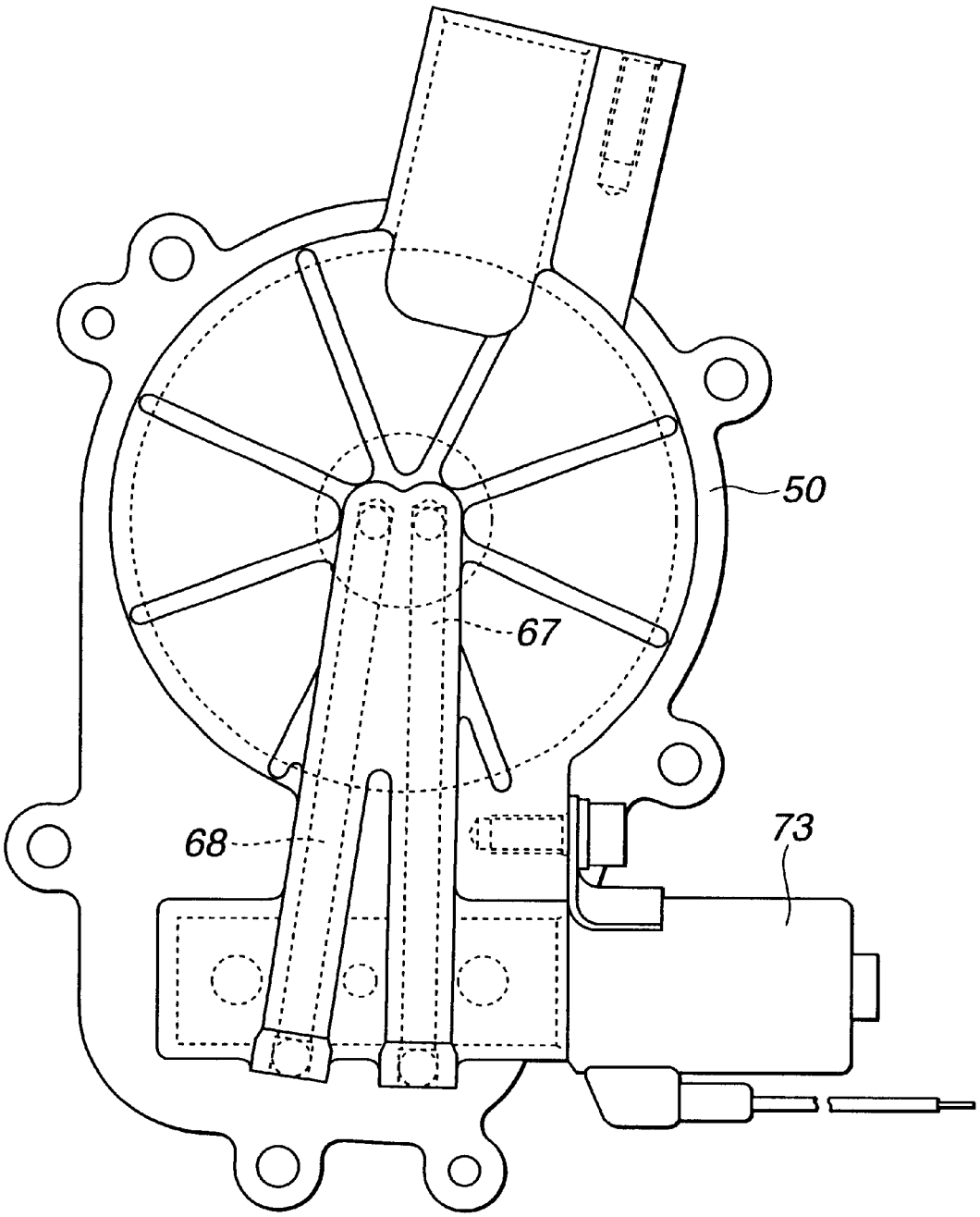
FIG. 4 is an elevation of the device as viewed from arrow 4 of FIG. 1.

The fluid control mechanism 66 is adapted to supply hydraulic fluid to the fluid pressure chambers 19 and 20 and discharge the hydraulic fluid therefrom. Specifically, the fluid control mechanism 66 is connected with a pump 69 as a fluid pressure source via a supply passage 70 and with a reservoir tank 71 via a drain passage 72. The fluid control mechanism 66 includes fluid paths 67 and 68 communicated with The pressure source-side fluid passages 51 and 52, a directional control valve 73 selectively establishing fluid communication between the fluid paths 67 and 68 and the supply passage 70 or the drain passage 72, or selectively preventing the fluid communication therebetween, and a controller 74 controlling the directional control valve 73. In this embodiment, as shown in FIG. 4, the fluid paths 67 and 68 are formed in the cover 50 and connected with the pressure source-side fluid passages 51 and 52 at substantially a right angle relative thereto. The directional control valve 73 is disposed within the cover 50 and it may be a four-port three-position valve as shown in FIG. 1. The controller 74 receives various signals indicative of operating conditions of the engine.

The fluid control mechanism 66 is connected with the pressure chamber-side fluid passage 25 of the vane rotor 15 via the pressure source-side fluid passage 51, the branch passage 54, the circumferential groove 55 and the intermediate portion of the axial bore 27. Thus, the fluid passage 51, the branch passage 54, the groove 55 and the intermediate portion of the axial bore 27 constitute one communication fluid path connecting the pressure chamber-side fluid passage 25 of the vane rotor 15 with the fluid control mechanism 66. The fluid control mechanism 66 is also connected with the pressure chamber-side fluid passage 26 of the vane rotor 15 via the pressure source-side fluid passage 52 and the bottom portion of the axial bore 27. The fluid passage 52 and the bottom portion of the axial bore 27 constitute the other communication fluid path connecting the pressure chamber-side fluid passage 26 of the vane rotor 15 with the fluid control mechanism 66.

When the pump 69 is not conditioned for supplying sufficient hydraulic fluid upon startup of the engine or when the controller 74 receives the signal indicative of maintaining the most delayed state of the cam shaft 1, the vane rotor 15 is placed in a most delayed position relative to the housing 4 as shown in FIG. 2. In this state, the lock pin 34 of the lock mechanism 31 is urged toward the lock hole 35 by the spring 33 so that the tapered end portion of the lock pin 34 is engaged into the lock hole 35 as shown in FIG. 1. The housing 4 and the vane rotor 15 are thus connected with each other. This allows a driving torque transmitted from the crankshaft to the rotary element 3 via the timing chain 9, to be further transmitted to the cam shaft 1 via the housing 4 and the vane rotor 15. Thus, the cam shaft 1 is rotated to actuate the intake valve of the engine. At this time, each vane 18 of the vane rotor 15 is not in contact with a side face of each projection 12 defining the chamber 13 within the housing 4. When the vane rotor 15 is in the most delayed position relative to the housing 4, the relative rotation of the housing 4 and the vane rotor 15 is prevented by the engagement between the lock pin 34 and the lock hole 35. The vane 18 can be restrained from being impinged against the side face of the projection 12 even if a reverse, i.e., positive or negative, torque is applied to the cam shaft 1. This can effectively avoid the occurrence of noise caused by the impingement of the vane 18 against the side face of the projection 12.

Next, in the case of advancing control, the directional control valve 73 is controlled by the controller 74 so as to establish the fluid communication between the fluid path 67 and the supply passage 70 and at the same time establish the fluid communication between the fluid path 68 and the drain passage 72. The hydraulic fluid from the pump 69 is fed to the fluid pressure chamber 19 via the fluid path 67, the pressure source-side fluid passage 51, the branch passage 54, the circumferential groove 55 and the pressure chamber-side fluid passage 25. Simultaneously, the hydraulic fluid within the fluid pressure chamber 20 is discharged to the drain passage 72 via the pressure chamber-side fluid passage 26, the bottom portion of the axial bore 27, the pressure source-side fluid passage 52 and the fluid path 68.

The hydraulic fluid within the fluid pressure chamber 19 then is introduced into the fluid pressure chamber 41 within the lock hole 35 of the receptacle 40 through the fluid hole 42. With the introduction of the hydraulic fluid into the fluid pressure chambers 19 and 41, the fluid pressures within the fluid pressure chambers 19 and 41 increase. The increased fluid pressure within the fluid pressure chamber 41 is applied to the lock pin 34 so that the lock pin 34 is urged toward the spring retainer 36 against the spring force of the spring 33 and retarded into the cylinder bore 32 of the vane 18. This causes the tapered end portion of the lock pin 34 to be disengaged from the lock hole 35, allowing disconnection of the vane rotor 15 from the housing 4. Simultaneously, the increased fluid pressure within the fluid pressure chamber 19 is applied to the side face of the vane 18 to rotate the vane rotor 15 relative to the housing 4 in a clockwise direction R shown in FIG. 2, namely, in an advancing direction. As a result, the cam shaft 1 and the rotary element 3 are allowed to rotate relative to each other so that a rotational phase of the cam shaft 1 relative to the crankshaft can be changed. The cam shaft 1 can be brought into the advanced position and then the opening and closing timings of the intake valve driven by the cam shaft 1 can be advanced. When the rotational phase of the cam shaft 1 is advanced and the vane rotor 15 is placed in a most advanced position relative to the housing 4, the lock pin 34 is kept within the cylinder bore 32 by the increased fluid pressure within the fluid pressure chamber 41 and the tapered end portion of the lock pin 34 is free from the contact with the end plate 6 of the housing 4.

Subsequently, when the directional control valve 73 of the fluid control mechanism 66 is controlled by the controller 74 so as to establish the fluid communication between the fluid path 68 and the supply passage 70 and at the same time establish the fluid communication between the fluid path 67 and the drain passage 72, the hydraulic fluid from the pump 69 is introduced into the fluid pressure chamber 20 via the pressure source-side fluid passage 52, the bottom portion of the axial bore 27 and the pressure chamber-side fluid passage 26 and simultaneously the fluid within the fluid pressure chamber 19 is discharged into the reservoir tank 71 via the pressure chamber-side fluid passage 25, the circumferential groove 55, the branch passage 54, the pressure source-side fluid passage 51 and the fluid path 67. The fluid pressure within the fluid pressure chamber 19 decreases due to the discharge of the hydraulic fluid within the fluid pressure chamber 19. The decrease of the fluid pressure associates with the spring force of the spring 33 to permit the lock pin 34 to project toward the lock hole 35. However, the housing 4 and the vane rotor 15 are kept in the relatively rotatable state until the tapered end portion of the lock pin 34 is brought into the engagement with the lock hole 35.

The fluid pressure within the fluid pressure chamber 20 increases due to the introduction of the hydraulic fluid into the fluid pressure chamber 20, while the fluid pressure within the fluid pressure chamber 19 decreases as explained above. The increased fluid pressure within the fluid pressure chamber 20 is applied to the side face of the vane 18 to rotate the vane rotor 15 relative to the housing 4 in a counter-clockwise direction as viewed in FIG. 2, namely, in a delaying direction. The cam shaft 1 and the rotary element 3 are allowed to rotate relative to each other so that the rotational phase of the cam shaft 1 relative to the crankshaft can be changed. The cam shaft 1 can again come into the delayed position and then the opening and closing timings of the intake valve driven by the cam shaft 1 can be delayed. In such a case that the rotational phase of the cam shaft 1 is delayed and the vane rotor 15 is placed in the most delayed position relative to the housing 4, the tapered end portion of the lock pin 34 is in the engagement with the lock hole 35.

Under condition that the vane rotor 15 is being rotated relative to the housing 4 in the advancing direction or delaying direction, when the directional control valve 73 is controlled by the controller 74 so as to prevent the fluid communication between the fluid paths 67 and 68 and the supply passage 70 or the drain passage 72, the vane rotor 15 is held in an intermediate position relative to the housing 4 between the most delayed position and the most advanced position. In this state, the cam shaft 1 is kept in an intermediate rotational position relative to the rotary member 3, in which the cam shaft 1 actuates the intake valve at a desired valve timing. In this case, the fluid pressure within the fluid pressure chamber 19 is maintained at a predetermined value without fluid communication with the supply passage 70 and the drain passage 72. This allows the lock pin 34 to be kept in the disengagement from the lock hole 35 in spite of application of the spring force of the spring 33 to the lock pin 34. As a result, the housing 4 and the vane rotor 15 are still kept in the relatively rotatable state.

As be apparent from the above discussion, the arrangement of the device of the invention can exhibit the following effects.

The shaft 49 can be neatly disposed within the axial bore 27 without projecting from the valve timing control device in such a manner that the pressure chamber-side fluid passages 25 and 26 are open to the axial bore 27 of the vane rotor 15 and the shaft 49 formed with the pressure source-side fluid passages 51 and 52 is received in the axial bore 27. This can serve for reducing a dimension of the device. Further, since the cam shaft 1 is not required to have fluid passages for supplying and discharging the hydraulic fluid, the device of the invention can be applied to the existing internal combustion engines. In addition, the head 29 of the bolt 28 connecting the vane rotor 15 with the cam shaft 1 is located on the bottom of the axial bore 27 without projecting the bolt 28 from the device, whereby the device can be reduced in size.

Since the shaft 49 is integrally formed with the cover 50 enclosing the device, the assembly work of the device such as the insertion of the shaft 49 into the axial bore 27 can be facilitated. Further, since the shaft 49 is a stationary member, it is unnecessary to design the dimension of the device for displacement of the shaft 49.

With the arrangement of the seals 58 and 59 in the annular space between the outer circumferential surface of the shaft 49 and the inner circumferential surface of the hub portion 17 which surrounds the axial bore 27, the hydraulic fluid within the axial bore 27 can be prevented from leaking through the annular space. This allows the hydraulic fluid to be effectively used, improving a response upon varying the valve timing.

The guide portion **45*a* of the sleeve 45 which is tapered so as to gradually increases the inner diameter, can easily guide outer circumferences of the seals 58 and 59, serving for readily receiving the seals 58 and 59 into the axial bore 27**.

The sleeve 45 is disposed inside the housing 4 so as to extend over the connection of the shell 5 and the end plate 6 and the seal 58 is in contact with a portion of the inner circumferential surface of the sleeve 45 which is located over the connection of the shell 5 and the end plate 6. With the arrangement, deterioration of sealing by the seal 58 which will be caused if the seal 58 is directly located in direct contact with the connection of the shell 5 and the end plate 6, can be avoided. Further, layout of the seal 58 can be selected with variety.

The sleeve 45 and vane rotor 15 made of a high hardness material can be considerably protected from wear caused due to the friction contact with the seals 58 and 59.

The arrangement in which the fluid paths 67 and 68 of the fluid control mechanism 66 are connected with the pressure source-side fluid passages 51 and 52 at substantially the right angle, can serve for reducing an axial length of the shaft 49 and then a size of the device. Further, since the directional control valve 73 and the fluid paths 67 and 68 of the fluid control mechanism 66 are disposed within the cover 50 integrally formed with the shaft 49, a continuously extending fluid passage extending from the valve 73 to the pressure source-side fluid passages 51 and 52 of the shaft 49 via the fluid paths 67 and 68 can be provided. This can prevent leakage of the hydraulic fluid.

Figure 5:
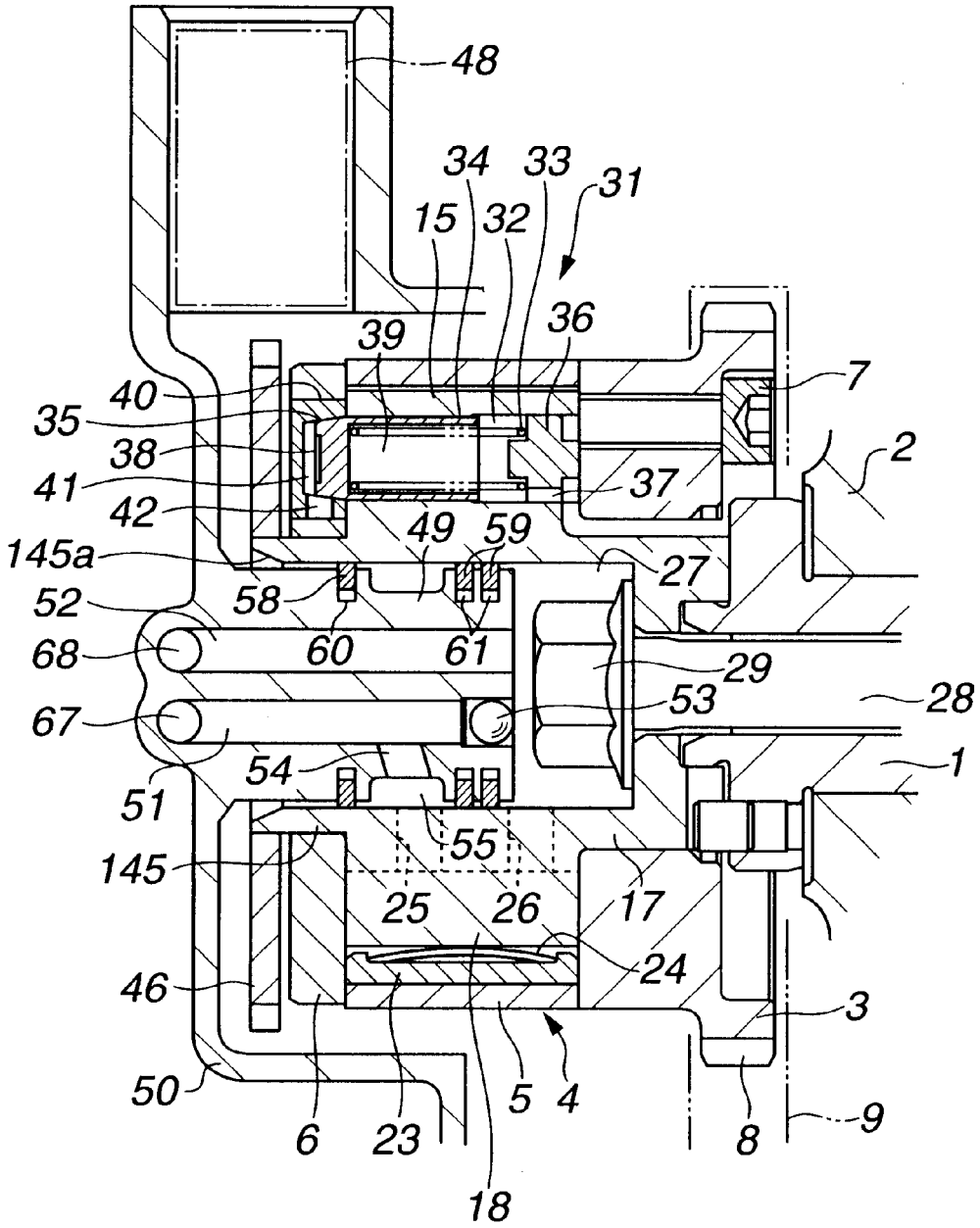
FIG. 5 is a diagram similar to FIG. 1, but showing a second embodiment of the device according to the present invention.

Referring to FIG. 5, a second embodiment of the device of the invention will be explained, which differs from the first embodiment in a sleeve 145 integrally formed with the vane rotor 15. Like reference numerals denote like parts and therefore detailed explanations therefor are omitted.

As illustrated in FIG. 5, the sleeve 145 axially extends from the axial end of the hub portion 17 toward the cover 50. The sleeve 145 is received in an opening of the target plate 46 formed as a separate part, through the opening of the end plate 6. The sleeve 145 has at an axial end thereof a guide portion 145*a* for guiding parts such as the seals 58 and 59, similar to the guide portion 45*a* of the sleeve 45 of the first embodiment.

Although the seal grooves 61 and 62 are formed in the outer circumferential surface of the shaft 49 in the above embodiments, the seal grooves 61 and 62 may be formed in the inner circumferential surface of the sleeve 45 and 145 and the inner circumferential surface of the hub portion 17. In such a case, the shaft 49 contacted with the seals 58 and 59 may be made of a high hardness material and be formed with a tapered end portion acting as the guide portion.

Although the invention has been described above by reference to certain embodiments of the invention, the invention is not limited to the embodiments described above. Modifications and variations of the embodiment described above will occur to those skilled in the art, in light of the above teachings. The scope of the invention is defined with reference to the following claims.

What is claimed is::

1. A valve timing control device for varying an opening and closing timing of an engine valve in an internal combustion engine, the device being disposed between a rotary element synchronously rotating with a crankshaft and a camshaft actuating the engine valve, the device comprising:

a housing adapted to rotate with one of the rotary element and the camshaft;

a vane rotor disposed within said housing, said vane rotor having an axial bore having an open end and pressure chamber-side fluid passages open to said axial bore, said vane rotor being adapted to rotate with the other of the rotary element and the camshaft, said vane rotor defines a bottom of the axial bore;

a vane radially extending from said vane rotor and defining within said housing at least a pair of fluid pressure chambers communicating with said pressure chamber-side fluid passages, respectively, said fluid pressure chambers being circumferentially disposed within said housing;

a fluid control mechanism for supplying a hydraulic fluid to said fluid pressure chambers and discharging the hydraulic fluid therefrom; and a shaft received in said axial bore of said vane rotor through said open end, said shaft being formed with pressure source-side fluid passages communicating with said pressure chamber-side fluid passages and said fluid control mechanism.

2. A valve timing control device as claimed in claim 1, further comprising a cover enclosing the valve timing control device, said shaft being integrally formed with the cover.

3. A valve timing control device as claimed in claim 2, further comprising a seal preventing fluid communication between the fluid passages via an annular space defined by the shaft within the axial bore of the vane rotor, said seal being disposed within the annular space.

4. A valve timing control device as claimed in claim 1, wherein the vane rotor comprises a tapered portion located on the open end of the axial bore, said tapered portion defining an increased diameter of the axial bore.

5. A valve timing control device as claimed in claim 3, further comprising a sleeve cooperating with the vane rotor to define the axial bore.

6. A valve timing control device as claimed in claim 5, wherein the seal comprises a seal received in a seal groove circumferentially extending in either one of an inner circumferential surface of the sleeve which defines the axial bore, and an outer circumferential surface of the shaft.

7. A valve timing control device as claimed in claim 6, wherein either one of the sleeve and the shaft which is in contact with the seal, is made of a high hardness material.

8. A valve timing control device as claimed in claim 5, wherein the housing comprises a hollow annular shell and an end plate closing one end of the shell, said sleeve being disposed radially inward the end plate.

9. A valve timing control device as claimed in claim 8, further comprising a target plate used for detecting a cam angle.

10. A valve timing control device as claimed in claim 9, wherein the target plate is integrally formed with the sleeve.

11. A valve timing control device as claimed in claim 1, wherein the vane rotor is connected with the camshaft by means of a bolt, said bolt comprising a head disposed on said bottom of the axial bore of the vane rotor.

12. A valve timing control device as claimed in claim 11, wherein one of the pressure source-side fluid passages has one end open to the axial bore of the vane rotor and opposed to the bottom of the axial bore.

13. A valve timing control device as claimed in claim 3, wherein the seal comprises a seal received in a seal groove circumferentially extending in either one of an inner circumferential surface of the vane rotor which defines the axial bore, and an outer circumferential surface of the shaft.

14. A valve timing control device as claimed in claim 13, wherein either one of the vane rotor and the shaft which is in contact with the seal, is made of a high hardness material.

15. A valve timing control device as claimed in claim 1, wherein the fluid control mechanism comprises fluid paths communicated with the pressure source-side fluid passages, said fluid paths being located at substantially a right angle relative to the pressure source-side fluid passages.

16. A valve timing control device as claimed in claim 2, wherein the fluid control mechanism comprises a directional control valve, said directional control valve being disposed within said cover.

17. A valve timing control device as claimed in claim 1, further comprising a lock mechanism for restricting relative rotation of the housing and the vane rotor, said lock mechanism comprising a fluid pressure chamber fluidly communicated with predetermined ones of the fluid pressure chambers.

18. A valve timing control device as claimed in claim 9, further comprising a cam angle sensor detecting the cam angle.

19. A valve timing control device as claimed in claim 18, wherein the cam angle sensor is mounted to the cover in an opposed relation to the target plate.

20. A valve timing control device as claimed in claim 18, wherein the cam angle sensor is located perpendicular to a rotation axis of the vane rotor.

21. A valve timing control device as claimed in claim 9, wherein the target plate comprises a portion disposed between the cover and the end plate in a direction of a rotation axis of the vane rotor.

22. A valve timing control device, comprising:

a housing;

a vane rotor with at least one vane and rotatable relative to said housing, said vane rotor having an axial bore and fluid passages open to the axial bore, said vane rotor defines a bottom of the axial bore;

at least a pair of fluid pressure chambers defined by the housing and the vane rotor with the vane, said fluid passages being open to the fluid pressure chambers, respectively;

a lock mechanism for restricting relative rotation of the housing and the rotor, said lock mechanism comprising a fluid pressure chamber fluidly communicated with one of the pair of fluid pressure chambers;

a fluid control mechanism for supplying a hydraulic fluid to the fluid pressure chambers and discharging the hydraulic fluid therefrom;

a shaft received in the axial bore of the rotor;

first communication fluid path communicating with one of the pair of fluid pressure chambers and the fluid control mechanism via the corresponding fluid passage, said first communication fluid path being formed in the shaft; and second communication fluid path communicating with the other of the pair of fluid pressure chambers and the fluid control mechanism via the corresponding fluid passage, said second communication fluid path being formed in the shaft.

23. A valve timing control device as claimed in claim 22, further comprising a seal cooperating with the shaft to divide the axial bore into a first portion and a second portion and prevent fluid communication between the first and second portions, said first communication fluid path being open to the first portion, said second communication fluid path being open to the second portion.

24. A valve timing control device as claimed in claim 23, wherein the first communication fluid path comprises an axial passage extending in the axial direction of the shaft, a branch passage branched from the axial passage and a circumferential groove communicated with the branch passage and circumferentially extending in an outer circumferential surface of the shaft, and the second communication fluid path comprises a second axial passage extending in the axial direction of the shaft and open to the second portion of the axial bore.

25. A valve timing control device as claimed in claim 23, further comprising a cover enclosing the valve timing control device, said shaft being integrally formed with the cover.

26. A valve timing control device as claimed in claim 23, wherein the seal comprises a seal mounted to either one of the vane rotor and the shaft.

27. A valve timing control device as claimed in claim 25, wherein the housing comprises a hollow annular shell receiving the vane rotor and an end plate closing one end of the shell, said end plate being spaced from the cover.

28. A valve timing control device as claimed in claim 27, further comprising a sleeve cooperating with the vane rotor to define the axial bore.

29. A valve timing control device as claimed in claim 28, wherein the sleeve is integrally formed with the vane rotor.

30. A valve timing control device as claimed in claim 28, wherein the seal comprises a seal mounted to either one of the sleeve and the shaft.

31. A valve timing control device as claimed in claim 27, further comprising a target plate used for detecting a cam angle.

32. A valve timing control device as claimed in claim 31, further comprising a cam angle sensor detecting the cam angle.

33. A valve timing control device as claimed in claim 32, wherein the cam angle sensor is mounted to the cover in an opposed relation to the target plate.

34. A valve timing control device as claimed in claim 32, wherein the cam angle sensor is located perpendicular to a rotation axis of the vane rotor.

35. A valve timing control device as claimed in claim 31, wherein the target plate comprises a portion disposed between the cover and the end plate in a direction of a rotation axis of the vane rotor.

* * * * *